US006688224B2

(12) United States Patent
Herda et al.

(10) Patent No.: US 6,688,224 B2
(45) Date of Patent: Feb. 10, 2004

(54) ROTARY-BLADE FOLDING UNIT

(75) Inventors: Philippe Francois Herda, Nogent sur Oise (FR); Serge Lanvin, Cires les Mello (FR); Thierry Vauchelle, Ravenel (FR); Yannis Woloch, Bourges (FR)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/119,344

(22) Filed: Apr. 9, 2002

(65) Prior Publication Data

US 2002/0144612 A1 Oct. 10, 2002

(30) Foreign Application Priority Data

Apr. 9, 2001 (DE) ..... 101 17 710

(51) Int. Cl.[7] ..... B41F 13/56; B42C 1/00; B31F 1/08

(52) U.S. Cl. ..... 101/227; 270/49; 270/50; 493/425; 493/426

(58) Field of Search ..... 101/227, 224, 101/225, 228, 231, 232; 271/3.01, 3.14, 8.1, 278; 400/578, 582, 587; 270/1.01, 4, 5.01, 6, 16, 20.1, 21.1, 39.7, 40, 41, 42, 45, 49, 50; 493/395, 396, 397, 399, 405, 408–409, 418–429, 434, 439–442, 444, 446, 453

(56) References Cited

U.S. PATENT DOCUMENTS

| | | | | | |
|---|---|---|---|---|---|
| 3,787,042 | A | * | 1/1974 | Hertrich | 493/449 |
| 4,279,410 | A | * | 7/1981 | Bolza-Schunemann | 270/6 |
| 5,171,204 | A | * | 12/1992 | Muller | 493/444 |
| 5,368,540 | A | * | 11/1994 | Saab | 493/424 |
| 5,468,209 | A | * | 11/1995 | Rohrhiursch et al. | 493/424 |
| 5,525,099 | A | * | 6/1996 | Baird et al. | 451/415 |
| 5,779,232 | A | * | 7/1998 | Ochsner | 270/45 |
| 2002/0046666 | A1 | * | 4/2002 | Bialek | 101/226 |

FOREIGN PATENT DOCUMENTS

| | | |
|---|---|---|
| DE | 30 46 051 A1 | 6/1982 |
| DE | 91 15 031.0 U1 | 2/1992 |
| DE | 43 06 097 A1 | 10/1993 |
| DE | 43 35 049 A1 | 4/1994 |

* cited by examiner

*Primary Examiner*—Andrew H. Hirshfeld
*Assistant Examiner*—Hoai-An D. Nguyen
(74) *Attorney, Agent, or Firm*—Laurence A. Greenberg; Werner H. Stemer; Gregory L. Mayback

(57) ABSTRACT

A rotary-blade folding unit includes at least one folding blade, a pair of folding rollers and a drive for producing a hypocycloid movement of the folding blade about a rotational axis of the folding blade and a main rotational axis for folding a signature that has been guided up to the rotary-blade folding unit in a transport plane extending between the main rotational axis and the folding rollers, and further includes a drive mechanism for producing an oscillatory movement of the folding blade at least approximately parallel to the main rotational axis; a folder including the folding unit; and a printing machine in combination with the folder.

12 Claims, 4 Drawing Sheets

ROTARY-BLADE FOLDING UNIT

BACKGROUND OF THE INVENTION

Field of the Invention

The invention relates to a rotary-blade folding unit having at least one folding blade, a pair of folding rollers and a drive for producing an hypocycloid movement of the folding blade about a blade axis of rotation and a main axis of rotation for folding a signature guided up to the rotary-blade folding unit in a transport plane extending between the main axis of rotation and the folding rollers.

Rotary-blade folding units, in general, have become known heretofore from the literature. For example, the French Patent 78 21 876 discloses a folder which comprises a rotary-blade folding unit for printing material webs or signatures cut from the latter, such as paper, pasteboard or the like. In the rotary-blade folding unit, the folding blade performs a periodic movement on a hypocycloid path about a main axis of rotation. On the travel path thereof, the folding blade pushes the printing material, which is guided in a transport plane up to the rotary-blade folding unit, into a nip between two folding rollers. Typically, such folders are arranged downstream of a web-fed rotary printing machine or offset printing machine, as viewed in the travel direction of the printing material. The printing-material web which arrives in the folder is folded and cut up both longitudinally and transversely with respect to the transport direction, so that individual signatures can be produced.

Rotary-blade folding units frequently serve for producing a longitudinal fold, i.e., a fold that is parallel to the transport direction of the signatures guided up to the rotary-blade folding unit. In this regard, the velocity vectors of the signature movement and of the hypocycloid movement of the folding blade are at least approximately perpendicular to one another. In other words, the relative movement of the signature and the folding blade along the coordinates determined by the transport direction is at least approximately equal to the transport speed of the signature. At the increasingly high processing speed of signatures in folders, a consequence thereof is that a signature can be damaged due to the abrupt contact thereof with the folding blade, i.e., due to retardation forces and acceleration forces occurring in physical directions perpendicular to the transport direction, during the process. For example, frictional traces or scratches may occur.

SUMMARY OF THE INVENTION

It is accordingly an object of the invention to provide a rotary-blade folding unit or mechanism wherein, during operation, a reduced risk of damage to the signature to be processed, in particular at high machine speeds, is achieved.

With the foregoing and other objects in view, there is provided, in accordance with one aspect of the invention, a rotary-blade folding unit, comprising at least one folding blade, a pair of folding rollers and a drive for producing a hypocycloid movement of the folding blade about a rotational axis of the folding blade and a main rotational axis for folding a signature that has been guided up to the rotary-blade folding unit in a transport plane extending between the main rotational axis and the folding rollers, and further comprising a drive mechanism for producing an oscillatory movement of the folding blade at least approximately parallel to the main rotational axis.

In accordance with another feature of the invention, the drive mechanism for producing the oscillatory movement is coupled with the drive for producing the hypocycloid movement.

In accordance with a further feature of the invention, the oscillatory movement of the drive mechanism has a cycle rate synchronized with a machine cycle rate.

In accordance with an added feature of the invention, the oscillatory movement is synchronized with movement of the signature.

In accordance with an additional feature of the invention, a projection of relative speed between the folding blade and the signature onto the main rotational axis is at least approximately zero, at least during part of the duration of a folding operation.

In accordance with yet another feature of the invention, the oscillatory movement of the folding blade parallel to the main rotational axis has an amplitude which is adjustably variable.

In accordance with yet a further feature of the invention, the drive mechanism for producing the oscillatory movement is operatively connected to the rotational movement about the rotational axis of the folding blade.

In accordance with yet an added feature of the invention, the drive mechanism for producing the oscillatory movement comprises an eccentrically mounted shaft having a shaft gear meshing with a worm gear coaxial with the rotational axis of the folding blade.

In accordance with another aspect of the invention, there is provided a folder for producing signatures from at least one printing material web, the folder having at least one rotary-blade folding unit, comprising at least one folding blade, a pair of folding rollers and a drive for producing a hypocycloid movement of the folding blade about a rotational axis of the folding blade and a main rotational axis for folding a signature that has been guided up to the rotary-blade folding unit in a transport plane extending between the main rotational axis and the folding rollers, and further comprising a drive mechanism for producing an oscillatory movement of the folding blade at least approximately parallel to the main rotational axis.

In accordance with a further aspect of the invention, there is provided a printing machine for printing on a printing material web, in combination with at least one folder for producing signatures from at least one printing material web, the folder being located downstream of the printing machine in a direction of travel of the signatures, and having at least one rotary-blade folding unit, comprising at least one folding blade, a pair of folding rollers and a drive for producing a hypocycloid movement of the folding blade about a rotational axis of the folding blade and a main rotational axis for folding a signature that has been guided up to the rotary-blade folding unit in a transport plane extending between the main rotational axis and the folding rollers, and further comprising a drive mechanism for producing an oscillatory movement of the folding blade at least approximately parallel to the main rotational axis.

In accordance with an additional feature of the invention, the printing machine is a web-fed rotary printing machine.

In accordance with a concomitant feature of the invention, the printing machine is an offset printing machine.

Thus, the rotary-blade folding unit according to the invention, having at least one folding blade, a pair of folding rolls and a drive for producing a hypocycloid movement of the folding blade about a blade axis of rotation and a main axis of rotation, for folding a signature guided up to the rotary-blade folding unit in a transport plane running between the main axis of rotation and folding rollers, is distinguished in that a drive mechanism is provided for producing an oscillatory movement of the folding blade at least approximately parallel to the main axis of rotation. In addition to the hypocycloid movement which the folding blade executes with speed components which are at least approximately perpendicular to the transport direction of the signature, the folding blade can now also be moved with a speed component parallel to the transport direction of the signature. Due to the contemplated movement of the folding blade parallel to the direction of movement of the signature, it is possible to produce the relative speed between signature and folding blade during a time interval. Provision is advantageously made for the actual folding operation, i.e., the thrusting of the signature by the folding blade into the nip between the folding rollers, to take place during this time interval. Due to the reduced relative movement between folding blade and signature in the transport direction, the risk of damage is reduced. In addition, the folding quality, as in particular the precision of the fold, is increased.

The drive mechanism for producing the oscillatory movement can preferably be coupled to the drive for producing the hypocycloid movement. Expressed in another way, the drive for producing the oscillatory movement picks up energy from the drive for producing the hypocycloid movement. The cycle rate of the drive mechanism for producing the oscillatory movement can therefore be synchronized in a particularly simple way to the machine cycle rate which at least approximately determines the frequency of the signature processing. However, synchronization can also be achieved by individual drives for the drive mechanism for producing the oscillatory movement and the drive mechanism for producing the hypocycloid movement to be coordinated with one another. For example, in this case, consideration is given to servomotors which are electronically controllable and regulatable, respectively.

The oscillatory movement is particularly advantageously synchronized with the movement of the signature, so that for a specific processing speed or transport speed of the signatures, an appropriate oscillatory movement of the folding blade is performed. In this regard, with respect to the invention, it is immaterial whether this is a harmonic or nonharmonic movement. According to the invention, synchronization is intended to achieve the situation wherein, in the time interval of the actual folding operation, the relative speed between folding blade and signature is at least approximately zero in the transport direction. In other words, the projection of the relative speed between folding blade and signature onto the main axis of rotation is at least approximately zero, at least during a portion of the time of the folding operation and a time interval which covers the actual folding operation, respectively.

In a particularly advantageous development of the invention, provision is made for the amplitude of the oscillatory movement of the folding blade parallel to the main axis of rotation to be adjustably variable. By adapting the amplitude in conjunction with the machine cycle rate defining the periodicity of the movement, it is possible for the speed profile of the oscillatory movement to be varied adjustably, because the slope of the route covered as a function of the time corresponds to the speed.

Furthermore, it is advantageous that there be an operative connection between the drive mechanism for producing the oscillatory movement and the drive mechanism for producing the rotational movement about the axis of rotation of the folding blade, which is defined by a blade rotation shaft. By this link, it is readily possible to tap off the movement energy, i.e., simply to convert the rotational movement about the axis of rotation of the folding blade, into an oscillatory movement in the direction of the axis of rotation of the folding blade and in the direction of the main axis of rotation, respectively, by providing an appropriate mechanism. In an advantageous embodiment, the drive mechanism for producing the oscillatory movement comprises an eccentrically mounted shaft.

To avoid signature damage, in particular at high processing speeds, the rotary blade folding mechanism according to the invention can be used particularly advantageously in a folder for producing signatures from at least one printing material web. A folder with a rotary-blade folding unit according to the invention is typically arranged downstream of a printing machine for printing on a printing material web. In particular, this may be a web-fed rotary printing machine or an offset printing machine.

Other features which are considered as characteristic for the invention are set forth in the appended claims.

Although the invention is illustrated and described herein as embodied in a rotary-blade folding unit, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
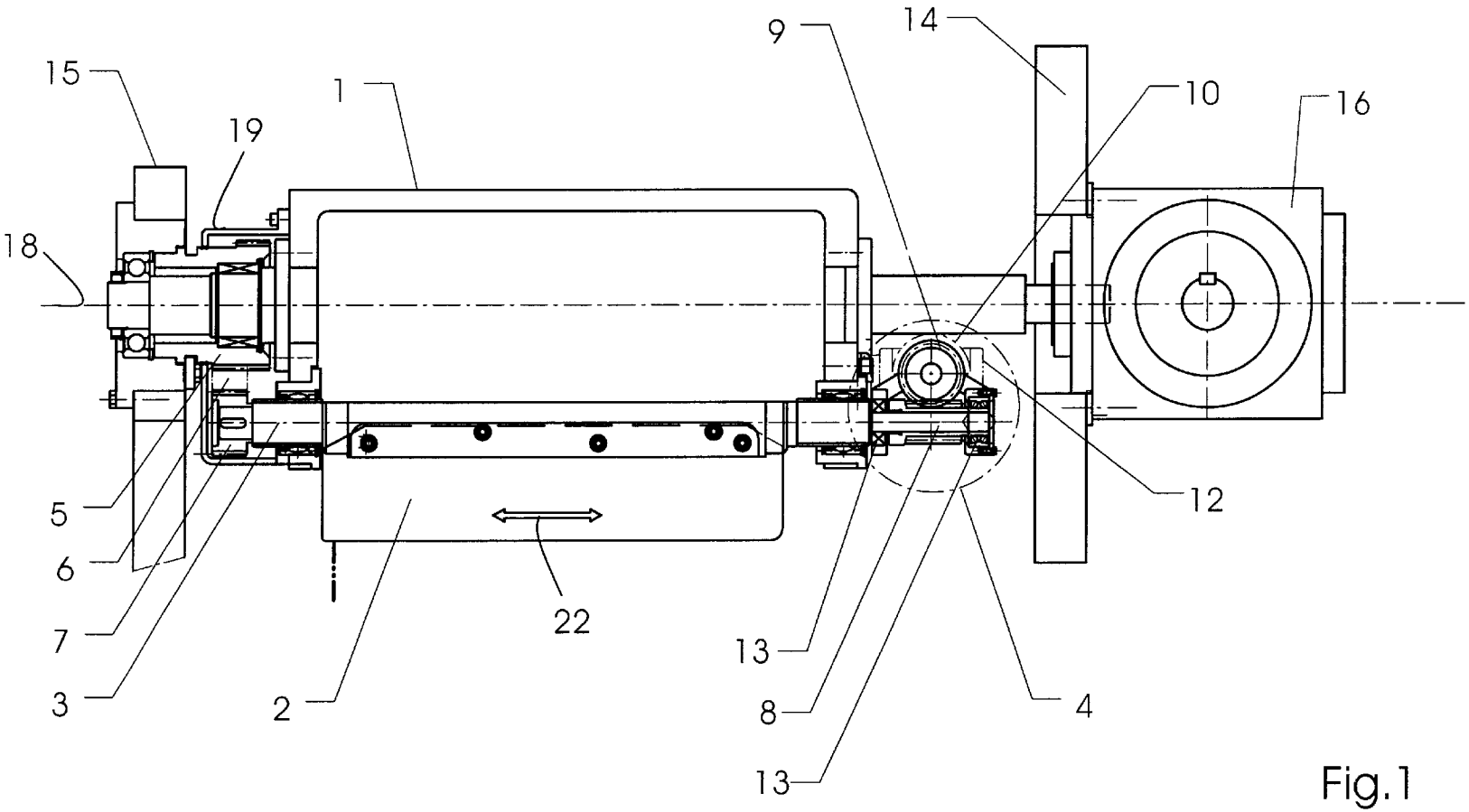
FIG. 1 is a diagrammatic side elevational view of a Rotary-blade folding unit according to the invention, having a drive mechanism for producing an oscillatory movement of the folding blade parallel to the main axis of rotation of a hypocycloid movement.

Referring now to the drawings and, first, particularly to FIG. 1 thereof, there is shown therein a diagrammatic representation of an embodiment of a rotary-blade folding unit according to the invention, which has a drive mechanism for producing an oscillatory hypocycloid movement of the folding blade thereof parallel to the main axis of rotation of the hypocycloid movement. The embodiment of the rotary-blade folding unit according to the invention comprises a blade cylinder 1, which is held in a first mounting 14 and a second mounting 15. This blade cylinder 1 can be set into rotation about a main rotational axis 18 by a drive source 16. A fixed gear 5 is mounted on the shaft of the main rotational axis 18. This fixed gear 5 meshes with an intermediate gear 6 which, in turn, meshes with a gear 7 mounted on the rotational shaft of the folding blade 2, which defines the rotational axis 3 of the folding blade 2. The folding blade 2 is held on the rotational axis 3 of the folding blade 2. Starting from the drive source 16, the folding blade 2 is therefore moved on a hypocycloid path, defined by the main axis of rotation 18 and the rotational axis 3 of the folding blade 2.

FIG. 1 also shows an embodiment of the drive mechanism 4 for the oscillatory movement of the folding blade 2 in the direction of oscillation represented by the arrow 22, i.e., at least approximately parallel to the main rotational axis 18 and/or the rotational axis 3 of the folding blade 2. In the preferred embodiment shown, the drive mechanism 4 for the oscillatory movement comprises a worm gear 8, which is set into rotation about the rotational axis 3 of the folding blade 2. This worm gear 8, through the intermediary of a shaft gear 9, sets an eccentric shaft 11 into rotation. The eccentric shaft 11 moves in a guide 12 having a first bearing 10 wherein the eccentric shaft 11 is held. The guide 12 is mounted on the blade cylinder 1. Because only an at least approximately rectilinear movement of the first bearing 10 is permitted, this mandatory condition leads to a translational movement of the drive mechanism 4, which sets the rotational shaft of the folding blade and rotational axis 3 of the folding blade, i.e., the folding blade 2 itself, respectively, into an oscillatory movement in the oscillating direction represented by the double-headed arrow 22.

Figure 2:
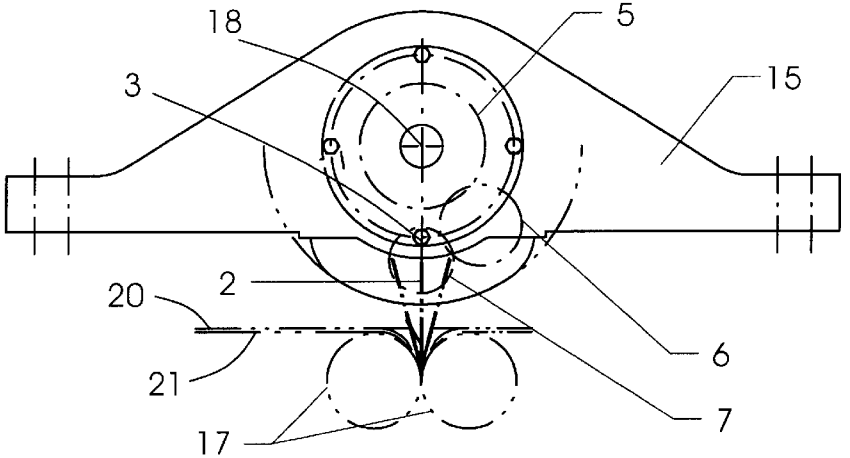
FIG. 2 is an enlarged left-hand end view of FIG. 1 showing diagrammatically the rotary-blade folding unit according to the invention extending along the main axis of rotation of the hypocycloid movement.

FIG. 2 is a diagrammatic end view of an embodiment of the rotary-blade folding unit according to the invention in a direction along the main axis of rotation about which the hypocycloid movement is executed. The folding blade 2 rotates about the rotational axis 3 of the folding blade 2, which in turn carries out a circular movement about the main rotational axis 18. In the advantageous embodiment, the rotation about the rotational axis 3 of the folding blade 2 is produced by a mechanism which provides an operative connection between the main rotational axis 18 and the rotational axis 3 of the folding blade 2. Coaxially fitted to the main rotational axis 18 is a fixed gear 5 meshing with an intermediate gear 6 which is, in turn, engaged with a gear 7 on the rotational shaft of the folding blade 2. Typically, a hypocycloid movement is carried out which is characterized by two rotations about the rotational axis 3 of the folding blade 2 during one rotation about the main rotational axis 18. In other words, the folding blade 2 carries out a hypocycloid movement which has two reversal points or vertex points which are located extremely distant from the main rotational axis 18 at mutually opposite points, i.e., rotated through 180° about the main rotational axis 18. Provision is made for one vertex point of the hypocycloid movement to be used for thrusting between two folding rollers 17 a signature 21, which had been guided in the transport plane 20 up to the rotary-blade folding unit. Typically, the signature 21 is transported up to the rotary-blade folding unit in the direction perpendicular to the plane of the drawing of FIG. 2.

Figure 3:
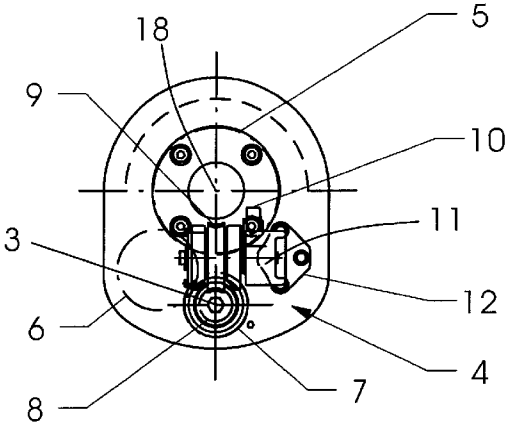
FIG. 3 is an enlarged fragmentary left-hand end view of FIG. 1 showing the encircled drive mechanism 4 for producing the oscillatory movement of the folding blade along the main axis of rotation of the hypocycloid movement.

FIG. 3 is a diagrammatic view of an embodiment of the drive mechanism for producing the oscillatory movement along the main axis of rotation. The drive mechanism 4 for producing an oscillatory movement of the folding blade 2 is in this case operatively connected to a drive 19 for producing the hypocycloid movement. The rotation about the main rotational axis 18, on the corresponding shaft of which a fixed gear 5 is fitted, is transmitted to the rotational axis 3 of the folding blade 2 by an intermediate gear 6 and a gear 7. In interaction between the worm gear 8 and the shaft gear 9, the worm gear 8 being fitted to the shaft corresponding to the rotational axis 3 of the folding blade 2, an eccentric shaft 11 is set into rotation about an axis extending at least approximately perpendicularly to the rotational axis 3 of the folding blade 2. Due to the mandatory condition of the guide 12 which has a first bearing 10, the eccentric shaft 11 is set into a translational movement in the guide 12, so that the folding blade 2 carries out an oscillatory movement.

Figure 4:
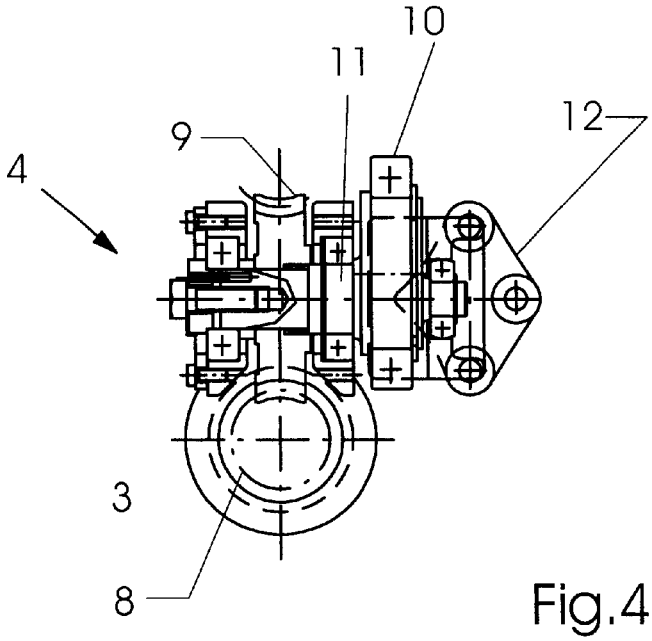
FIG. 4 is an enlarged fragmentary view of FIG. 3 showing diagrammatically and in greater detail the drive mechanism for producing the oscillatory movement of the folding blade along the main axis of rotation of the hypocycloid movement.

FIG. 4 is a diagrammatic detailed view of the drive mechanism for producing the oscillatory movement along the main axis of rotation, in an embodiment of the rotary-blade folding unit according to the invention. The rotational axis 3 of the folding blade 2, the corresponding shaft of which is provided with a worm gear 8 and is in rotation, sets an eccentric shaft 11 rotating through the intermediary of the shaft gear 9. The drive mechanism 4 for producing the oscillatory movement comprises the guide 12 having the first bearing 10, wherein the eccentric shaft 11 moves. In other words, there is a forced translational movement.

Figure 5A:
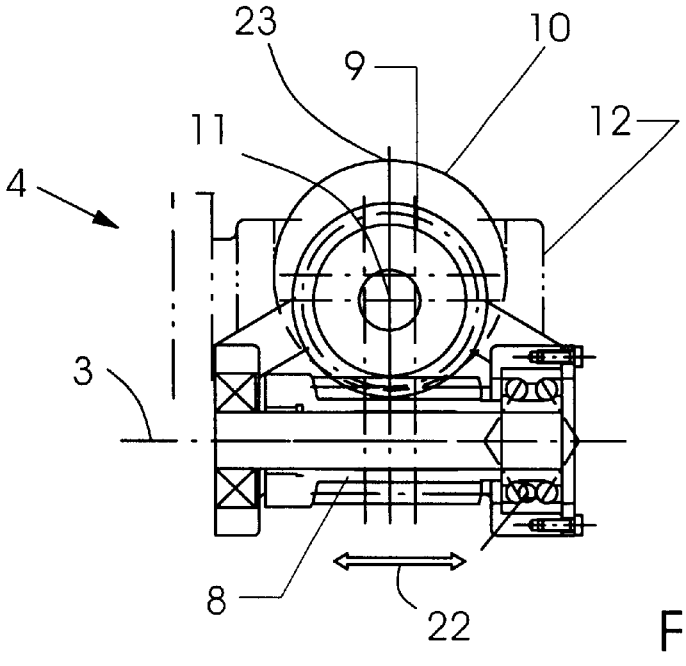
FIGS. 5*a* to 5*c* are enlarged fragmentary diagrammatic views of FIG. 1, showing the encircled drive mechanism 4 for producing the oscillatory movement of the folding blade at three different phase locations thereof during the movement.
Figure 5B:
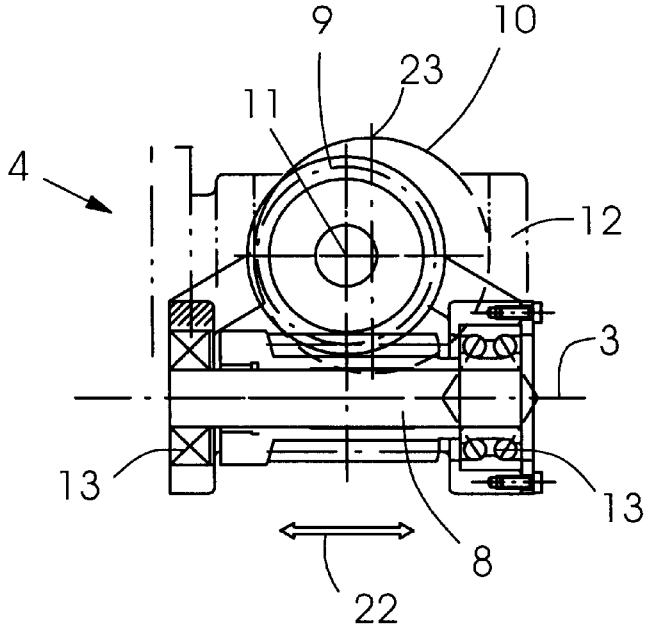
Figure 5C:
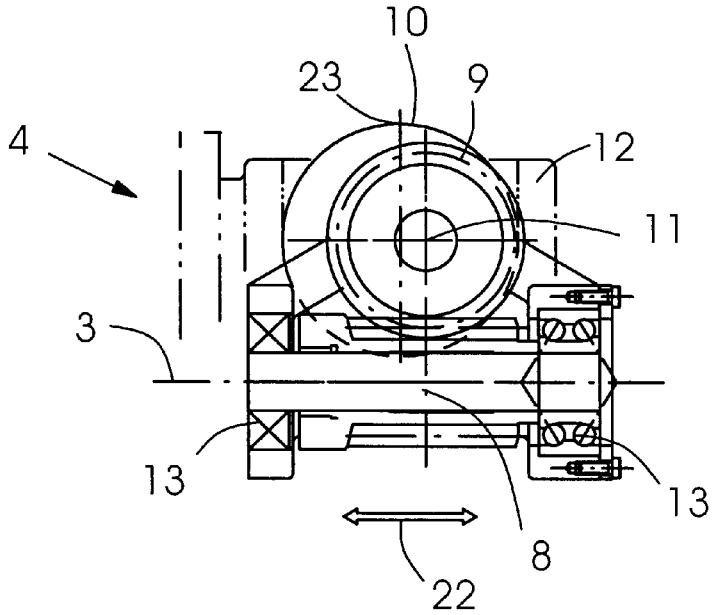

FIGS. 5*a* to 5*c* are a series of diagrammatic views of the drive mechanism for producing the oscillatory movement in an advantageous embodiment of the rotary-blade folding unit according to the invention, at three different phase locations in the movement. This is intended to illustrate how the rotational movement about the rotational axis 3 of the folding blade 2 can be converted by the drive mechanism 4 into an oscillatory movement along the rotational axis 3 of the folding blade 2. In FIG. 5*a,* the drive mechanism 4 for the oscillatory movement is shown in a view parallel to the rotational axis 3 of the folding blade 2. The worm gear 8 and the shaft gear 9 are in mutual engagement, and the eccentric shaft 11 is movable in the first bearing 10 of the guide 12. FIG. 5*b* then shows how, after a rotation about the rotational axis 3 of the folding blade 2, the eccentric shaft 11 has experienced a deflection to the lefthand side from the center line 23, which intersects the center of the first bearing 10. Because the guide 12 is connected to the blade cylinder 1, not shown here (but note FIG. 1, for example), while the bearing 13 of the eccentric shaft 11 is fitted to the rotational axis 3 of the folding blade 2, an oscillatory movement in the direction of the arrow 22 is produced. FIG. 5*c* illustrates a situation wherein the eccentric shaft 11 is at a location on the righthand side of the center line 23 which intersects the center of the first bearing.

We claim:

1. A rotary-blade folding unit, comprising at least one folding blade, a pair of folding rollers and a drive for producing a hypocycloid movement of said folding blade about a rotational axis of said folding blade and a main rotational axis for folding a signature that has been guided up to the rotary-blade folding unit in a transport plane extending between said main rotational axis and said folding rollers, and further comprising a drive mechanism for producing an oscillatory movement of said folding blade at least approximately parallel to said main rotational axis.

2. The rotary-blade folding unit according to claim 1, wherein said drive mechanism for producing the oscillatory movement is coupled with said drive for producing the hypocycloid movement.

3. The rotary-blade folding unit according to claim 1, wherein said oscillatory movement of said drive mechanism has a cycle rate synchronized with a machine cycle rate.

4. The rotary-blade folding unit according to claim 1, wherein said oscillatory movement is synchronized with movement of the signature.

5. The rotary-blade folding unit according to claim 4, wherein a projection of relative speed between said folding blade and the signature onto said main rotational axis is at least approximately zero, at least during part of the duration of a folding operation.

6. The rotary-blade folding unit according to claim 1, wherein said oscillatory movement of said folding blade parallel to said main rotational axis has an amplitude which is adjustably variable.

7. The rotary-blade folding unit according to claim 1, wherein said drive mechanism for producing said oscillatory movement is operatively connected to said rotational movement about said rotational axis of said folding blade.

8. The rotary-blade folding unit according to claim 1, wherein said drive mechanism for producing said oscillatory movement comprises an eccentrically mounted shaft having a shaft gear meshing with a worm gear coaxial with said rotational axis of said folding blade.

9. A folder for producing signatures from at least one printing material web, the folder having at least one rotary-blade folding unit, comprising at least one folding blade, a pair of folding rollers and a drive for producing a hypocycloid movement of said folding blade about a rotational axis of said folding blade and a main rotational axis for folding a signature that has been guided up to the rotary-blade folding unit in a transport plane extending between said main rotational axis and said folding rollers, and further comprising a drive mechanism for producing an oscillatory movement of said folding blade at least approximately parallel to said main rotational axis.

10. A printing machine for printing on a printing material web, in combination with at least one folder for producing signatures from at least one printing material web, the folder being located downstream of the printing machine in a direction of travel of the signatures, and having at least one rotary-blade folding unit, comprising at least one folding blade, a pair of folding rollers and a drive for producing a hypocycloid movement of said folding blade about a rotational axis of said folding blade and a main rotational axis for folding a signature that has been guided up to the rotary-blade folding unit in a transport plane extending between said main rotational axis and said folding rollers, and further comprising a drive mechanism for producing an oscillatory movement of said folding blade at least approximately parallel to said main rotational axis.

11. The printing machine according to claim 10, which is a web-fed rotary printing machine.

12. The printing machine according to claim 10, which is an offset printing machine.

* * * * *